US008224206B2

(12) United States Patent
Kang

(10) Patent No.: US 8,224,206 B2
(45) Date of Patent: Jul. 17, 2012

(54) FUSING UNIT INCLUDING ROLLER ADJUSTMENT MECHANISM AND IMAGE FORMING APPARATUS HAVING THE SAME

(75) Inventor: Nae Wan Kang, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1101 days.

(21) Appl. No.: 12/102,153

(22) Filed: Apr. 14, 2008

(65) Prior Publication Data

US 2008/0292345 A1 Nov. 27, 2008

(30) Foreign Application Priority Data

May 25, 2007 (KR) ..... 2007-51060

(51) Int. Cl.
*G03G 15/16* (2006.01)

(52) U.S. Cl. ..... 399/122; 399/67; 399/331; 399/332

(58) Field of Classification Search ..... 399/67, 399/122, 328, 331, 332, 339
See application file for complete search history.

(56) References Cited

U.S. PATENT DOCUMENTS

2006/0239715 A1* 10/2006 Lee et al. ..... 399/122
2007/0019977 A1* 1/2007 Sawamura et al. ..... 399/67
2007/0019979 A1* 1/2007 Fujii et al. ..... 399/67

FOREIGN PATENT DOCUMENTS

JP 05289564 A * 11/1993
KR 2007-12191 1/2007

* cited by examiner

*Primary Examiner* — David Gray
*Assistant Examiner* — Laura Roth
(74) *Attorney, Agent, or Firm* — Stanzione & Kim, LLP

(57) ABSTRACT

An image forming apparatus includes a photosensitive body on which an electrostatic latent image is formed, an exposure device to irradiate light to the photosensitive body to form the electrostatic latent image, a developing device to adhere a developer to the photosensitive body to form a visible image, a transfer device to transfer the visible image formed on the photosensitive body onto a printing medium, and a fusing unit to fuse the visible image to the printing medium. The fusing unit includes a heating roller to apply heat to the printing medium, a press roller to contact the heating roller to press the printing medium, a press lever to press any one of the heating roller and the press roller to the other, an adjusting lever rotatably coupled to the press lever, and a pressing force adjusting device to operate the adjusting lever to move the press lever. Accordingly, a fusing pressure between the heating roller and the press roller can be decreased with a small force by operating the adjusting lever hingedly coupled to the press lever.

18 Claims, 14 Drawing Sheets

FUSING UNIT INCLUDING ROLLER ADJUSTMENT MECHANISM AND IMAGE FORMING APPARATUS HAVING THE SAME

CROSS-REFERENCE TO RELATED APPLICATIONS

This application claims the benefit of Korean Patent Application No. 2007-0051060, filed on May 25, 2007 in the Korean Intellectual Property Office, the disclosure of which is incorporated herein by reference in its entirety.

BACKGROUND OF THE INVENTION

1. Field of the Invention

The present general inventive concept relates to an electrophotographic image forming apparatus, and more particularly to a fusing unit and an image forming apparatus having the same which fuses a visible image to a printing medium.

2. Description of the Related Art

An image forming apparatus is an apparatus that prints a black and white image or a color image on a printing medium, e.g., paper, according to an inputted image signal, for example, a laser printer, an ink-jet printer, a copying machine, a multi-function printer, a fax machine, etc. An image forming apparatus is classified as an electrophotographic type device in which light is irradiated to a photosensitive body to form an electrostatic latent image and a developer adheres to the electrostatic latent image to transfer the same onto a printing medium, or an ink-jet type device in which a liquid type ink is ejected onto a surface of a printing medium according to an image signal.

Of the two device types, the electrophotographic image forming apparatus is configured such that a surface of a photosensitive body is charged with a predetermined electric potential, a light beam is scanned to the photosensitive body to form an electrostatic latent image due to generation of an electric potential difference, and a developer, i.e., a toner, adheres to the electrostatic latent image to form a visible image. The visible image formed on the photosensitive body is transferred onto the printing medium, and is fused to the surface of the printing medium.

In order to fuse the visible image formed by the developer to the surface of the printing medium, the electrophotographic image forming apparatus has a fusing unit which applies heat and pressure to the printing medium onto which the visible image has been transferred.

The fusing unit generally includes a heating roller which generates heat of a high temperature, and a press roller which is mounted so as to closely contact the heating roller. The heating roller includes a heat source such as a lamp, a heating element or the like, an aluminum pipe provided around the heat source, and a release layer provided on the surface of the aluminum pipe. The press roller is provided with an elastic layer on its outer surface, and is in close contact with the heating roller. The press roller can be separated from the heating roller to remove the printing medium if it becomes jammed between the heating roller and the press roller. During the printing operation, the visible image-transferred printing medium receives heat and pressure while passing between the heating roller and the press roller, and the visible image is fused to the surface of the printing medium.

The fusing unit is set so that the heating roller and the press roller closely contact each other at a pressing force adequate for a thickness of a commonly-used printing medium (e.g., A4 paper). When a printing medium, e.g., an envelope, which is thicker than the common printing medium passes through the fusing unit, the envelope may become wrinkled or crumpled due to the excessive fusing pressure.

To cope with this problem, when printing the printing medium which is thicker than the common printing medium, the fusing pressure between the heating roller and the press roller should be decreased. However, the conventional image forming apparatus is difficult to adjust in use such that a user manually adjusts (decreases or increases) the pressing force between the heating roller and the press roller according to the kind of printing medium (the relatively thicker printing medium or the common printing medium) to be used.

Korean Patent Laid-Open Publication No. 2007-0012191 (published on Jan. 25, 2007) discloses a fusing unit of an image forming apparatus is capable of automatically adjusting the pressing force between the heating roller and the press roller.

But, such a fusing unit is constituted such that a press lever supporting the press roller is elastically supported by a compression spring, and a cam operated by a driving unit directly presses the press lever, thereby automatically adjusting the pressing force between the press roller and the heating roller.

However, such a fusing unit has a problem such that a relatively large force is necessary to move the press lever when adjusting the pressing force between the heating roller and the press roller, because of difficulty of directly pressing the press lever which is elastically supported by the compression spring.

Further, because the press lever supporting the press roller is structured to move automatically, when the printing medium is jammed between the heating roller and the press roller, it is difficult to manually separate the heating roller and the press roller form each other. As a result, it is not easy to remove the jammed printing medium.

SUMMARY OF THE INVENTION

The present general inventive concept provides a fusing unit and an image forming apparatus having the same which can automatically adjust a fusing pressure between a heating roller and a press roller according to a printing medium to be used and can easily remove a jammed printing medium.

Additional aspects and utilities of the general inventive concept will be set forth in part in the description which follows and, in part, will be obvious from the description, or may be learned by practice of the general inventive concept.

The present general inventive concept also provides a fusing unit and an image forming apparatus having the same which can accurately adjust a fusing pressure between a heating roller and a press roller with a small force.

The foregoing and/or other aspects of the present general inventive concept can be achieved by providing an image forming apparatus including a photosensitive body on which an electrostatic latent image is to be formed, an exposure device to irradiate light to the photosensitive body to form the electrostatic latent image, a developing device to adhere a developer to the photosensitive body to form a visible image, a transfer device to transfer the visible image formed on the photosensitive body onto a printing medium, and a fusing unit which includes a heating roller to apply heat to the printing medium, a press roller to contact the heating roller to press the printing medium, a press lever to press any one of the heating roller and the press roller to the other, an adjusting lever rotatably coupled to the press lever, and a pressing force adjusting device to operate the adjusting lever to move the press lever.

The image forming apparatus may further include a first elastic member to elastically support the press lever.

The pressing force adjusting device may include an operating member to operate the adjusting lever, and a driving source which operates the operating member.

The image forming apparatus may further include a frame to rotatably support the press lever, where the adjusting lever may include a hinge portion which is hingedly coupled to the press lever, a first lever portion which extends from one side of the hinge portion to be pressed by the operating member, and a second lever portion which extends from an opposite side of the hinge portion, and when the operating member presses the first lever portion, the second lever portion may rotate on the hinge portion while contacting the frame, and may rotate the press lever.

The image forming apparatus may further include an operating gear which is coupled to the operating member, the operating gear having gear teeth disposed only on a portion of an outer periphery, and a driving gear which is provided between the driving source and the operating gear to transmit a driving force from a driving source to the operating gear, the driving gear having gear teeth disposed only on a portion of an outer periphery.

The image forming apparatus may further include a position sensor to detect a rotational position of the operating gear, and a control device to receive a detecting signal from the position sensor and to control an operation of the driving source.

The operating gear may be provided with a detected part which extends outwardly therefrom, and the position sensor may be provided with a sensing region to sense the detected part. When the operating gear rotates such that the detected part is located in proximity to the sensing region, the position sensor may generate the detecting signal.

The sensing region may be provided in plural numbers in the position sensor to detect a position of the detected part and to provide a multi-step detect range, where the rotation of the operating gear may be controlled according to the position of the detected part, and a fusing pressure between the heating roller and the press roller may be set according to the multi-step detect range.

The image forming apparatus may further include a worm wheel which is coupled to the driving gear, and a worm which is provided at the driving source and is tooth-engaged with the worm wheel.

The image forming apparatus may further include a second elastic member to elastically support the operating gear and to return the operating gear to an initial position when the gear teeth of the operating gear are disengaged from the gear teeth of the driving gear, and a stopper to stop the operating gear returned by the second elastic member at the initial position.

The image forming apparatus may further include an opening/closing cover which is movably mounted to a main body of the image forming apparatus, to move between an opened position and a closed position, where the driving source, the operating gear and the driving gear may be coupled to the opening/closing cover.

The press lever, the adjusting lever and the operating member may be respectively provided in pairs at a first and second side portions of the frame, the operating gear and the driving gear may be respectively provided in pairs at the first and second side portions of the opening/closing cover, and the pair of the driving gears may be connected to each other through a connecting shaft to rotate together by the driving source.

When the opening/closing cover is opened, the operating gear may return to an initial position.

The pressing force adjusting device may automatically operate by selection of the printing medium through an external input device to control a printing operation.

The foregoing and/or other aspects of the present general inventive concept can also be achieved by providing a fusing unit including a frame, a heating roller mounted to the frame to apply heat to a printing medium, a press roller mounted to the frame to contact the heating roller to press the printing medium, a press lever to press any one of the heating roller and the press roller to the other, an adjusting lever hingedly coupled to the press lever, the adjusting lever having a portion to rotate while contacting the frame, and a pressing force adjusting device to operate the adjusting lever to move the press lever.

The fusing unit may include a first elastic member to elastically support the press lever.

The pressing force adjusting device may include an operating member to operate the adjusting lever, and a driving source to operate the operating member.

The press lever may be hingedly coupled to the frame, the adjusting lever may include a hinge portion which is hingedly coupled to the press lever, a first lever portion which extends from one side of the hinge portion to be pressed by the operating member, and a second lever portion which extends from an opposite side of the hinge portion, and when the operating member presses the first lever portion, the second lever portion may rotate on the hinge portion while contacting the frame, and moves the press lever.

The fusing unit may include an operating gear which is coupled to the operating member, the operating gear having gear teeth disposed only on a portion of an outer periphery, and a driving gear which is provided between the driving source and the operating gear to transmit a driving force from a driving source to the operating gear, the driving gear having gear teeth disposed only on a portion of an outer periphery.

The fusing unit may also include a position sensor to detect a rotational position of the operating gear.

The operating gear may be provided with a detected part which extends outwardly therefrom, and the position sensor is provided with a sensing region to sense the detected part, whereby when the operating gear rotates such that the detected part is located in the proximity of the sensing region, the position sensor generates a detecting signal.

The sensing region may be provided in plural numbers in the position sensor to detect a position of the detected part, whereby the rotation of the operating gear is controlled according to the position of the detected part, and a fusing pressure between the heating roller and the press roller is changed in a multi-step process.

The fusing unit may include a second elastic member to elastically support the operating gear and to return the operating gear to an initial position when the gear teeth of the operating gear are disengaged from the gear teeth of the driving gear, and a stopper to stop the operating gear returned by the second elastic member at the initial position.

The foregoing and/or other aspects of the present general inventive concept can also be achieved by providing a method of automatically controlling a fusing operation of an image forming apparatus for printing media of different thicknesses, the method including maintaining a fusing pressure between a heating roller and a press roller when a printing medium having a predetermined thickness is to be printed, and decreasing the fusing pressure according to a detected position of a rotating gear in a pressing force adjusting device when a printing media having a thickness greater than the predetermined thickness is to be printed.

The foregoing and/or other aspects of the present general inventive concept can also be achieved by providing a system to automatically control a fusing pressure on printing media having different thicknesses, including an input device to input a printing medium type to be printed, a fusing unit to fuse an image on a printing medium of a first thickness using a first fusing pressure and to fuse an image on a printing medium of a second thickness using a second fusing pressure, and a pressing force adjusting device connected to the fusing unit such that a heating roller and a press roller of the fusing unit are automatically moved into proximity to each other to begin a printing operation when an opening/closing cover disposed in proximity to the fusing unit is closed, and the heating roller and the press roller are automatically moved away from each other so there is no contact between them when the opening/closing cover is opened.

BRIEF DESCRIPTION OF THE DRAWINGS

These and/or other aspects and utilities of the general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
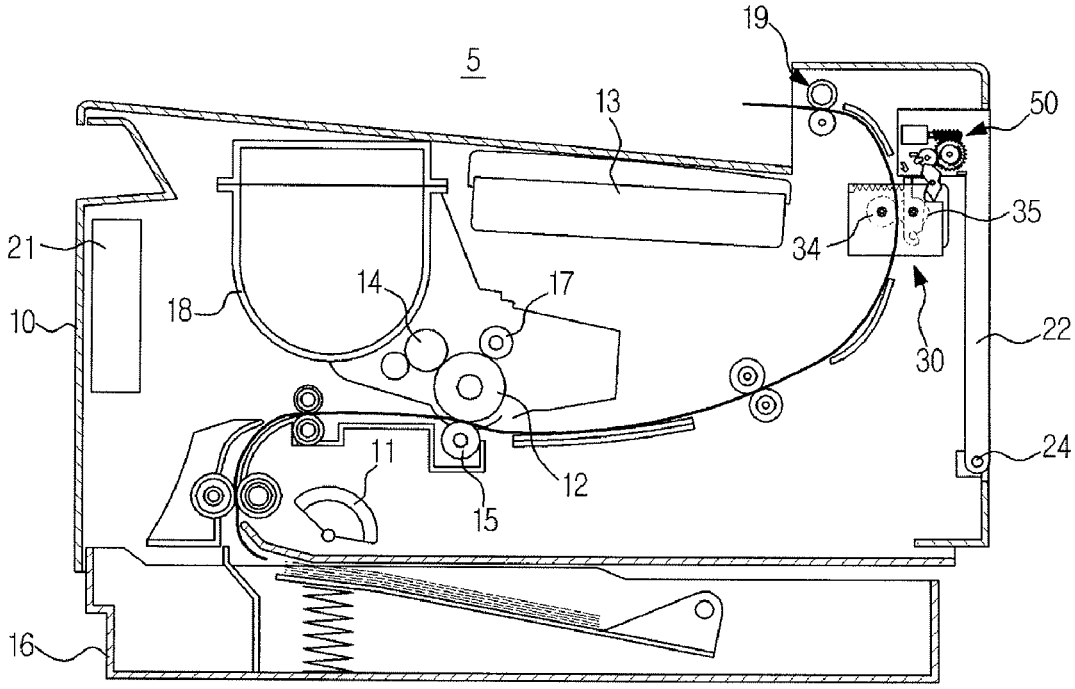
FIG. 1 is a side-sectional view schematically illustrating an image forming apparatus in accordance with the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

As illustrated in FIG. 1, an image forming apparatus 5 according to an embodiment of the present general inventive concept includes a main body 10 which forms an external surface, a pickup device 11 which picks up a printing medium, for example, printing paper, sheet by sheet, a photosensitive body 12 on which an electrostatic latent image is formed, an exposure unit 13 which irradiates light to the photosensitive body 12 according to an image signal, a developing device 14 which adheres a developer to the photosensitive body 12 on which the electrostatic latent image has been formed, a transfer device 15 which transfers a visible image formed on the photosensitive body 12 onto the printing medium, and a fusing unit 30 which fuses the visible image transferred onto the printing medium.

Moreover, the main body 10 of the image forming apparatus 5 contains a printing medium loading device 16 in which the printing medium is loaded, a charge device 17 which charges the photosensitive body 12 with a constant electric potential, a developer storage container 18 which stores the developer, a printing medium discharge device 19 which discharges from the image forming apparatus 5 the printing medium which has been printed, a main driving source (not illustrate) to generate a driving force, a control device 21 to control the overall operation of the image forming apparatus 5, and an opening/closing cover 22 which is opened and closed to remove a jammed printing medium.

If the printing operation of the image forming apparatus 5 of the present embodiment is initiated, the pickup device 11 picks up the printing medium loaded on the printing medium loading device 16 sheet by sheet, and feeds the same to the photosensitive body 12. Light generated by the exposure device 13 is irradiated onto the surface of the photosensitive body 12, which has been charged with a constant electric potential by the charge device 17, according to an image signal, and an electrostatic latent image is formed on the photosensitive body 12. A developer, which may be a developer powder, is supplied by the developing device 14 and adheres to an electrostatic latent image region of the photosensitive body 12, and a visible image is formed on the electrostatic latent image region by the adhered developer powder. The visible image is transferred onto the surface of the printing medium by the transfer device 15, and is fused to the surface of the printing medium when the printing medium passes through the fusing unit 30. The printing medium on which the image has been printed and fused thereon, is discharged externally from the main body 10 by the printing medium discharge device 19.

Figure 2:
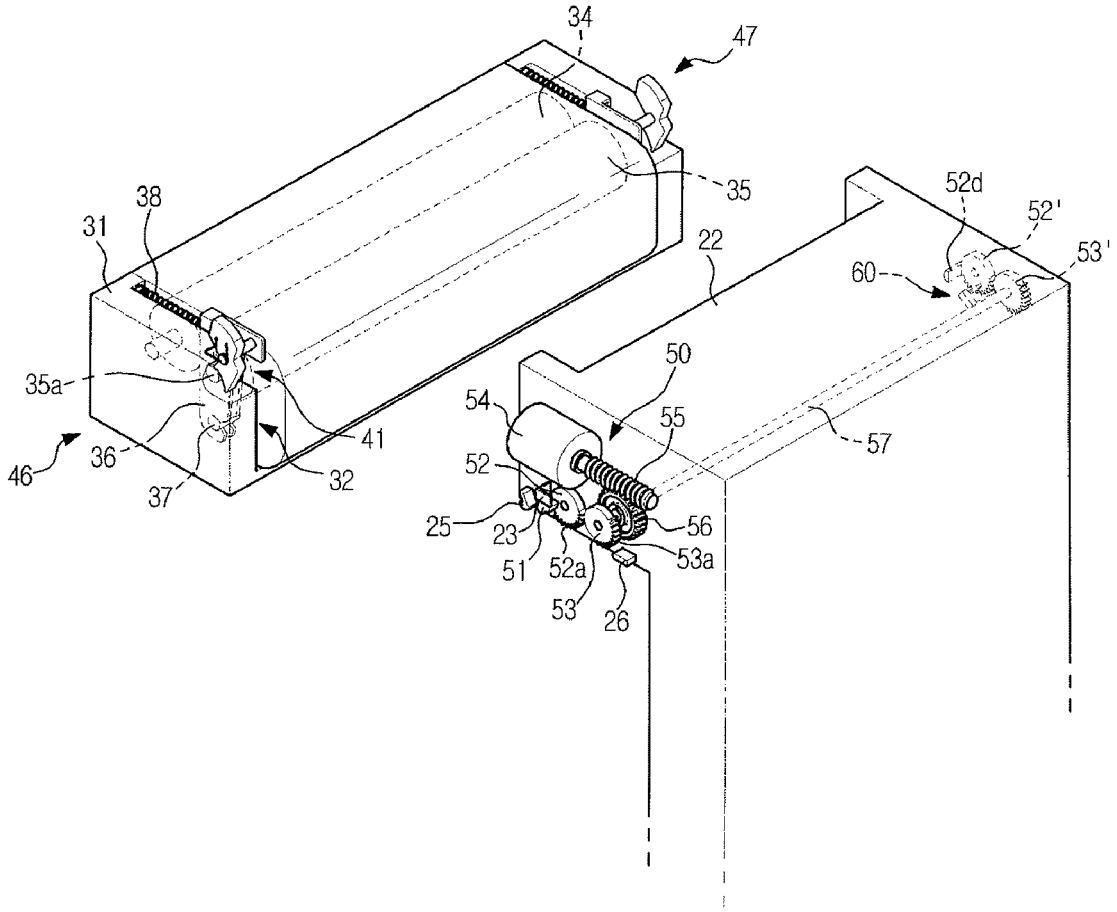
FIGS. 2 and 3 are perspective views schematically illustrating a fusing unit of the image forming apparatus of FIG. 1, in accordance with an embodiment of the present general inventive concept.

FIG. 2 illustrates a fusing unit 30 in accordance with an embodiment of the present general inventive concept. Referring to FIG. 2, the fusing unit 30 may include a frame 31 which is coupled to a portion of the interior of the main body 10, a heating roller 34 and a press roller 35 which are rotatably supported by the frame 31, and a pressing force adjusting device 50 to adjust a fusing pressure between the heating roller 34 and the press roller 35.

The heating roller 34 is to apply heat to the printing medium onto which the visible image has been transferred. The heating roller 34 may be a metal pipe (e.g., aluminum), and may contain a heater (not illustrated) to generate heat. The heating roller 34 is rotatably supported by the frame 31, and rotates by receiving a driving force from the main driving source (not illustrated) of the image forming apparatus 5.

The press roller 35 closely contacts the heating roller 34, and applies heat and pressure to the printing medium passing between the heating roller 34 and the press roller 35. The press roller 35 may have an elastic layer on its outer surface, which is elastically deformed when the press roller 35 closely contacts the heating roller 34.

Figure 3:
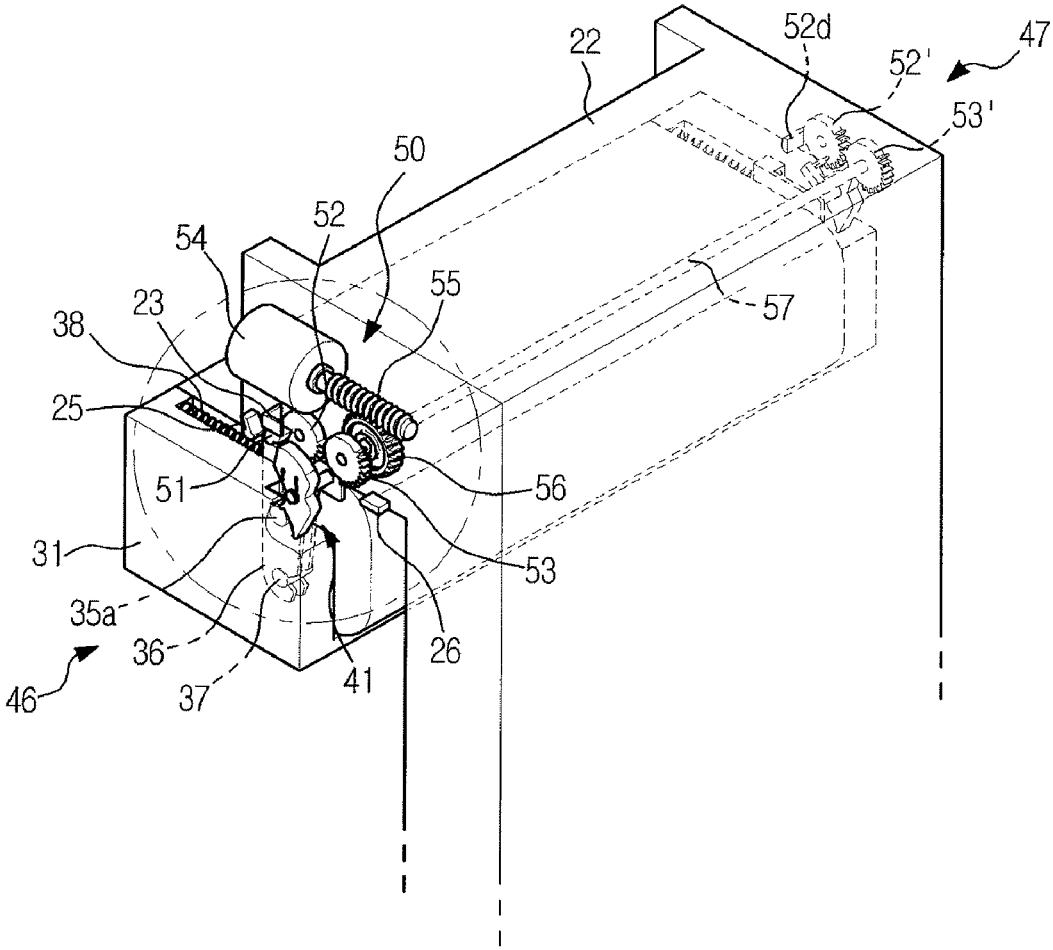
Figure 4:
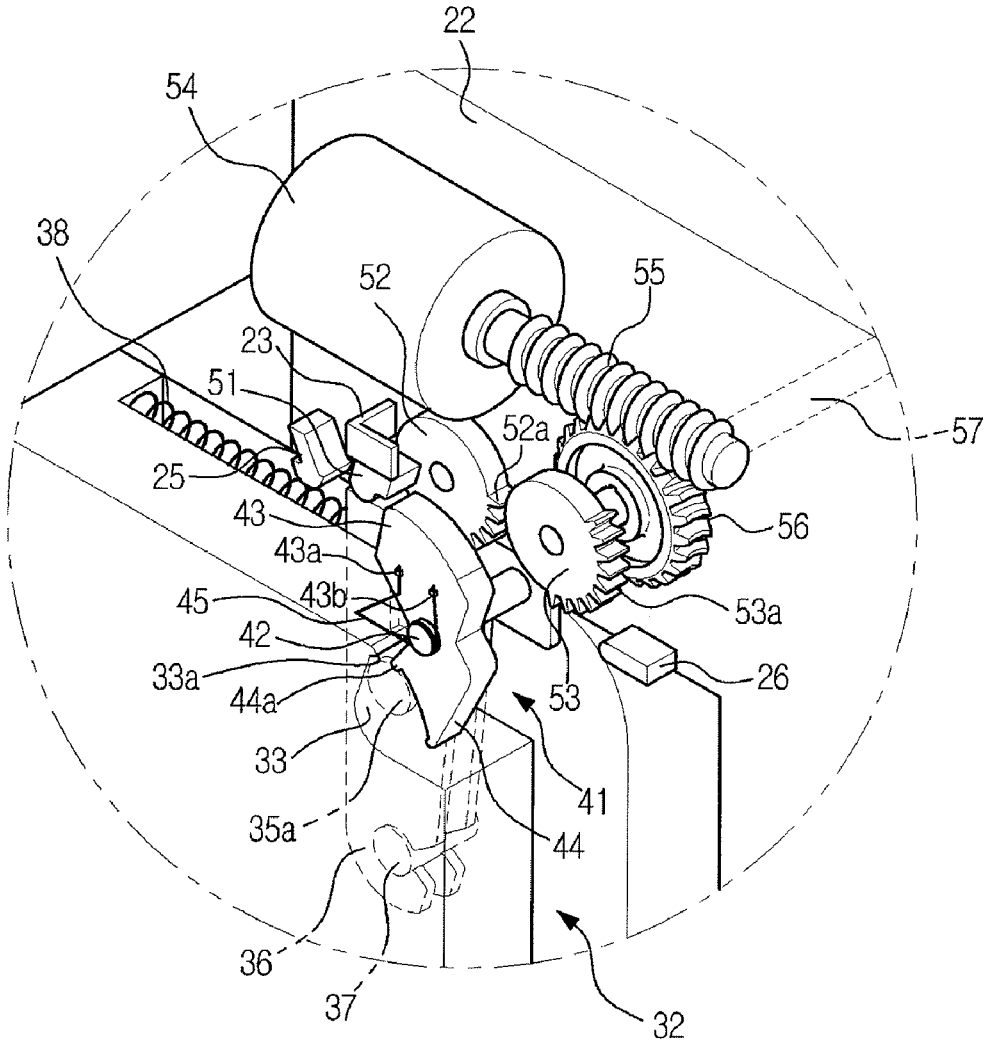
FIG. 4 is an enlarged perspective view illustrating a portion of the fusing unit depicted in FIG. 3.

As illustrated in FIGS. 2 to 4, the press roller 35 may be rotatably supported by a press lever 36 which may be hingedly coupled to the frame 31, and the press roller 35 may rotate at a predetermined angle. A rotating shaft 35*a* of the press roller 35 may be rotatably coupled to a central portion of the press lever 36. The press lever 36 may be hingedly coupled to a side portion of the frame 31 by a first hinge shaft 37. If the press lever 36 moves while supporting the press roller 35, the press roller 35 may move away from or closer to a center axis of the heating roller 34, and thus a fusing pressure between the heating roller 34 and the press roller 35 can be increased or decreased.

If the press lever 36 moves in a reverse direction (e.g., in a counterclockwise direction with reference to FIGS. 2-4), the pressing force between the heating roller 34 and the press roller 35 increases. If the press lever 36 moves in a forward direction (e.g., in a clockwise direction with reference to FIGS. 2-4), the pressing force between the heating roller 34 and the press roller 35 decreases. The frame 31 may be provided with an opening portion 32 in which the press lever 36 can rotate at a predetermined angle. A first elastic member 38 may be mounted to the frame 31 to provide an elastic force to closely contact the press roller 35 toward the heating roller 34. One end of the first elastic member 38 may be fixedly attached to the frame 31, and another end of the first elastic member 38 may be fixedly attached to an upper portion of the press lever 36 to provide an elastic force to elastically support the press lever 36. As illustrated in FIGS. 2 and 3, the first elastic member 38 may be a tension spring, however it may be any other elastic member which provides an elastic force substantially equivalent to a tension spring. The first elastic member 38 may be set so that the heating roller 34 and the press roller 35 closely contact each other at a pressing force adequate for a thickness of a common printing medium (e.g., A4 printing paper). Thus, so long as an external force in addition to the elastic force of the first elastic member 38 is not exerted on the press lever 36, the press roller 35 closely contacts the heating roller 34 at a pressing force adequate for the thickness of the common printing medium.

When the printing medium is jammed or various components of the fusing unit 30 need to be repaired or replaced, it may be necessary to separate the press roller 35 from the heating roller 34. In such a case, the press lever 36 is applied with an external force larger than the elastic force of the first elastic member 38, so that the press lever 36 rotates in the forward direction by a predetermined angular distance. The press roller 35 is thereby spaced apart from the heating roller 34. In one embodiment, the press lever 36 may be rotatably mounted to a portion of the interior of the main body 10.

An adjusting lever 41 may be hingedly coupled to an upper portion of the press lever 36 to rotate the press lever 36. The adjusting lever 41 may rotate the press lever 36 with a small force. The adjusting lever 41 may include a hinge portion 42 which may be hingedly coupled to the upper portion of the press lever 36, a first lever portion 43 which may extend from one end of the hinge portion 42 (e.g., upper end), and a second lever portion 44 which may extend from an opposite end of the hinge portion 42 (e.g., lower end). If an external force larger than the elastic force of the first elastic member 38 is applied to the first lever portion 43 in one direction (e.g., a direction from left to right with reference to FIG. 4), the second lever portion 44 may come into contact with a portion of the frame 31, and the first and second lever portions 43 and 44 rotate in the forward direction (e.g., in the clockwise direction with reference to FIG. 4) while centering on the hinge portion 42. At the same time, the adjusting lever 41 pulls the press lever 36 to rotate the press lever 36 in the forward direction. If the press lever 36 rotates in the forward direction, the press roller 35 moves away from the center axis of the heating roller 34, and the fusing pressure between the heating roller 34 and the press roller 35 is decreased. The press roller 35 will then be positioned at a predetermined distance from the heating roller 34 to allow a jammed paper medium to easily be removed.

An elastic support member 45 may be coupled to the adjusting lever 41 to maintain a constant position of the adjusting lever 41 in a normal operating state in which the press roller 35 is in close contact with the heating roller 34. The elastic support member 45 may be coupled to first and second fixing portions 43*a* and 43*b* of the adjusting lever 41, and may be in partial contact with the frame 31, thereby elastically supporting the adjusting lever 41. Therefore, if the adjusting lever 41 rotates excessively in the reverse direction by an external force, the elastic support member 45 is elastically deformed to provide an elastic force to return the adjusting lever 41 to the constant position. As illustrated in FIG. 4, the elastic support member 45 may be a torsion spring, however it may be any other elastic member to provide an elastic force substantially equivalent to the torsion spring.

As illustrated in FIG. 4, the frame 31 may be provided with a contact portion 33 which the second lever portion 44 may contact as the adjusting lever 41 is rotated. The contact portion 33 may be inclined at a predetermined angle, so that when the adjusting lever 41 rotates in a clockwise direction and the second lever portion 44 slides on the contact portion 33, the hinge portion 42 of the adjusting lever 41 moves away from the first hinge shaft 37 of the press lever 36, and thus the rotation of the adjusting lever 41 pulls the press lever 36 forward in a clockwise direction. When the press lever 36 rotates by a predetermined angular distance and the press roller 35 is separated from the heating roller 34, the adjusting lever 41 stops rotating and is kept in a stationary state at a fixed position. For this to occur, the second lever portion 44 may be provided with a fixing protrusion 44*a*, and the contact portion 33 of the frame 31 may be provided with a latching protrusion 33*a* on an upper portion of the contact portion 33. If the adjusting lever 41 rotates such that the fixing protrusion 44*a* slides on the contact portion 33 and moves over the latching protrusion 33*a*, the fixing protrusion 44*a* is caught and held in place by the latching protrusion 33*a*. If the fixing protrusion 44*a* is caught by the latching protrusion 33*a* of the frame 31, the rotation in the forward direction of the adjusting lever 41 is limited. Accordingly, though the press lever 36 is pulled in a reverse direction by the elastic force of the first elastic member 38, the press lever 36 cannot rotate in the reverse direction, and the press roller 35 is kept in the stationary state at a predetermined distance from the heating roller 34.

As illustrated in FIGS. 2 and 3, the press lever 36, the first elastic member 38, the adjusting lever 41 and the contact portion 33 are provided in pairs at first and second side portions 46 and 47 of the frame 31.

As illustrated in FIGS. 2 to 5, the pressing force adjusting device 50 may include an operating member 51 and an operating gear 52 to rotate the adjusting lever 41 in the forward direction by applying pressure to the adjusting lever 41, a driving gear 53 to rotate the operating gear 52, and a driving source 54 to generate a driving force in the pressing force adjusting device 50.

Figure 6:
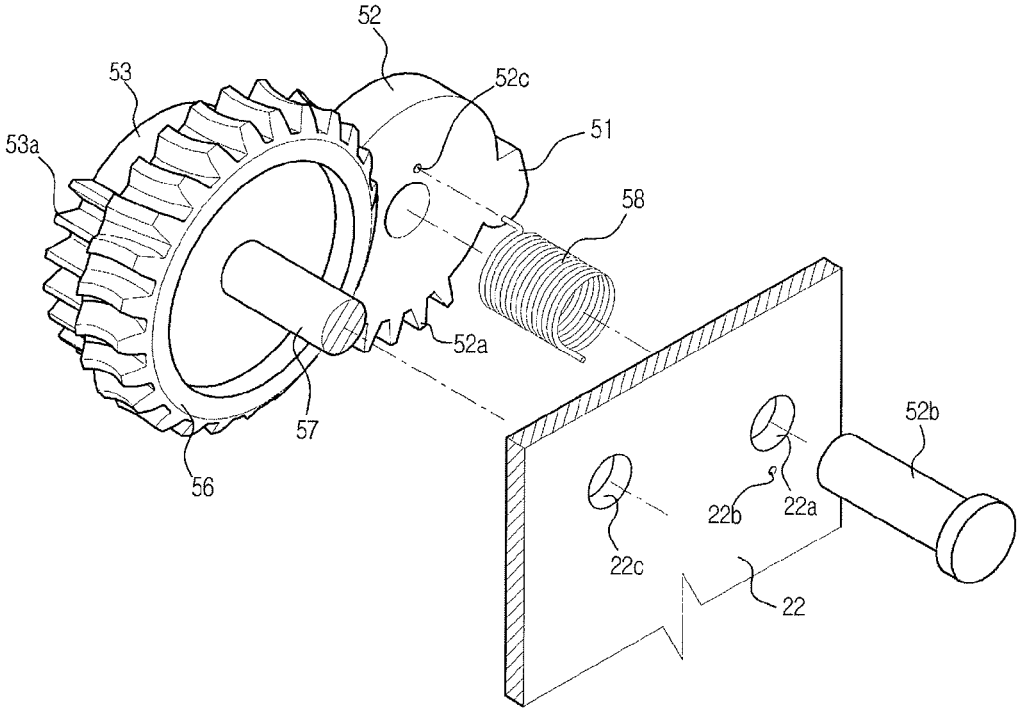
FIG. 6 is an exploded perspective view illustrating a portion of the pressing force adjusting device depicted in FIG. 5.

The operating member 51 may be formed integrally on the operating gear 52, and may protrude outwardly from the operating gear 52. The operating gear 52 may be rotatably supported by a side portion of the opening/closing cover 22. As illustrated in FIG. 4, if the operating gear 52 rotates in the reverse direction (e.g., in the counterclockwise direction with reference to FIG. 4), the operating member 51 also moves in the reverse direction to come into contact with and press against the first lever portion 43 of the adjusting lever 41. As illustrated in FIG. 6, the operating gear 52 may be coupled to a support shaft 52*b* fitted through a support hole 22*a* of the opening/closing cover 22, and may be elastically supported by a second elastic member 58 which may be fixedly attached to the opening/closing cover 22. One end of the second elastic member 58 may be inserted through a first fixing hole 22*b* provided on the opening/closing cover 22, and a second opposite end may be inserted through a second fixing hole 52*c* provided on the operating gear 52. Accordingly, if the operating gear 52 rotates by an external force, the second elastic member 58 may be elastically deformed. If the external force applied to the operating gear 52 is released, the operating gear 52 is returned to its original position by the elastic force of the second elastic member 58.

Figure 5:
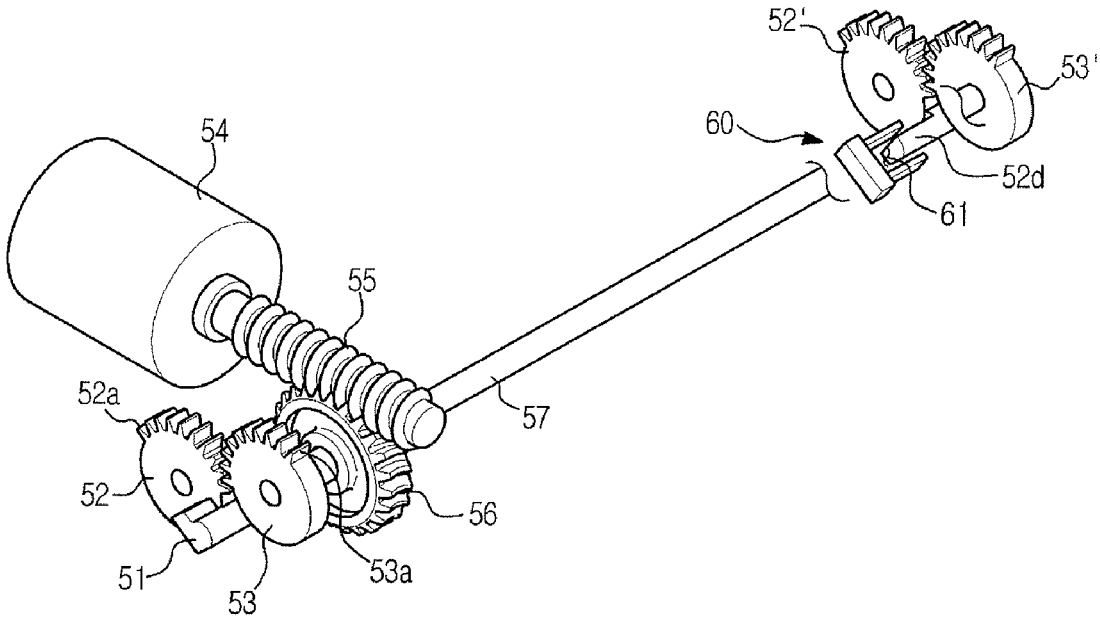
FIG. 5 is a perspective view schematically illustrating an embodiment of a pressing force adjusting device of the image forming apparatus in accordance with the present general inventive concept.

As illustrated in FIG. 4, a stopper 23 may be mounted to the opening/closing cover 22, to stop the operating gear 52 at an initial position when the operating gear 52 is returned to the initial position by the operation of the second elastic member 58, as described above. The stopper 23 protrudes outwardly from the side portion of the opening/closing cover 22. When the operating gear 52 rotates in the reverse direction by the elastic force provided by the second elastic member 58, an upper portion of the operating member 51 comes into contact with the stopper 23, and thus the operating gear 52 is stopped from rotating. The operating gear 52 may have gear teeth 52*a* disposed on only a portion of the outer periphery. As illustrated in FIG. 3, the operating member 51 and the operating gear 52 may be provided in pairs at the first and second side portions 46 and 47 of the opening/closing cover 22. Any one, or both, of the pair of operating gears 52 and 52' may be provided with a detected part 52*d*. As illustrated in FIG. 5, the detected part 52*d* may protrude toward a position sensor 60 which is mounted on the opening/closing cover 22.

The position sensor 60 detects a rotational position of the operating gear 52. The position sensor 60 may be provided with a sensing region 61 to sense the detected part 52*d* when the operating gear 52 rotates. If the operating gear 52 rotates and the detected part 52*d* is positioned within, or in close proximity to, the sensing region 61, the position sensor 60 generates a sensing signal and transmits the sensing signal to the control device 21. When this occurs, the control device 21 controls the driving source 54 to stop the rotation of the operating gear 52. The stop position of the operating gear 52 is predetermined such that the press roller 35 is positioned away from the center axis of the heating roller 34 and the fusing pressure between the heating roller 34 and the press roller 35 has decreased adequately for a relatively thick printing medium (e.g., an envelope) to be printed without excessive fusing pressure. The sensing region 61 of the position sensor 60 is set corresponding to the above condition.

Figure 7:
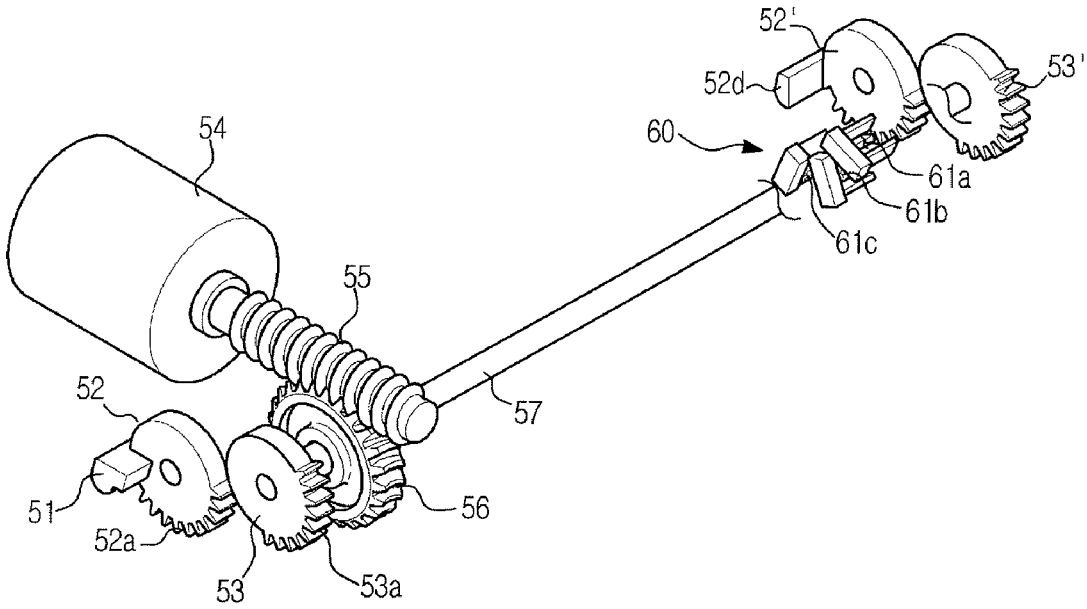
FIG. 7 is a perspective view illustrating another embodiment of the pressing force adjusting device in accordance with the present general inventive concept.
Figure 8:
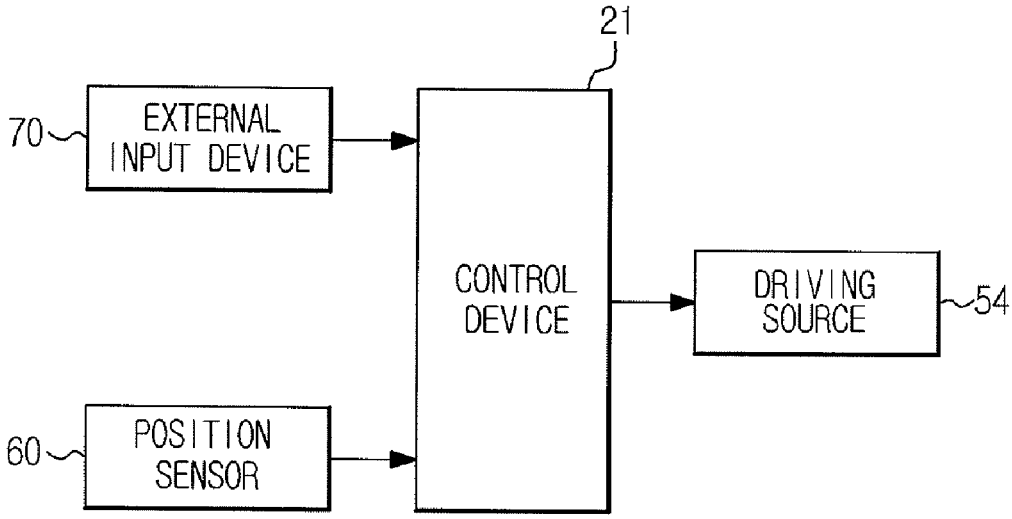
FIG. 8 is a block diagram illustrating an embodiment of a portion of the image forming apparatus in accordance with the present general inventive concept.

As illustrated in FIG. 7, if the position sensor 60 may be provided with plural sensing regions 61*a*, 61*b* and 61*c* along the moving path of the detected part 52*d*, thereby allowing the fusing pressure between the heating roller 34 and the press roller 35 to be adjusted in a multi-step detect range, or a multi-step process. In other words, by determining fusing pressures respectively adequate for the thicknesses of the various types of printing media and setting the plural sensing regions 61*a*, 61*b* and 61*c* correspondingly to the set respective fusing pressures, the rotational angular distance of travel of the operating gear 52 can be controlled adequately according to the thickness of the respective printing medium.

printing medium may be selected automatically, or by a user through an external input device 70 such as a display or a computer connected to the image forming apparatus 5. As illustrated in FIG. 8, the control device 21 of the image forming apparatus 5 is connected with the external input device 70 to which a printing command is inputted. If a user selects the printing medium through the external input device 70, the control device 21 controls the driving source 54 to adjust the fusing pressure of the fusing unit 30 adequately for the selected printing medium.

In an embodiment, the position sensor 60, to control the rotational angle of the operating gear 52, may be eliminated. In this embodiment, the rotational angular distance of the movement of the operating gear 52 can be controlled through an operating time or the number of rotations of the driving source 54.

As illustrated in FIGS. 2 to 4, the driving gear 53 may be rotatably supported by a side portion of the opening/closing cover 22. Similarly to the operating gear 52, the driving gear 53 may have gear teeth 53*a* disposed on only a portion of the outer periphery. Accordingly, the operating gear 52 and the driving gear 53 may not always be tooth-engaged with each other. Only when the driving gear 53 rotates so that the gear teeth 53*a* of the driving gear 53 are engaged with the gear teeth 52*a* of the operating gear 52, the operating gear 52 rotates. After the gear teeth 53*a* of the driving gear 53 are engaged with the gear teeth 52*a* of the operating gear 52, if the driving gear 53 rotates further, the gear teeth 53*a* of the driving gear 53 become disengaged from the gear teeth 52*a* of the operating gear 52. When this occurs, the operating gear 52 rotates in the forward direction by the elastic force provided by the second elastic member 58, and is returned to the initial position.

Because the operating gear 52 and the driving gear 53 may be partially formed with the gear teeth 52*a* and 53*a*, although the driving source 54 may work improperly and the driving gear 53 may rotate continuously, the operating gear 52 stops its rotation after rotating by a predetermined angular distance. Accordingly, the moving range of the operating member 51 is restricted, and stability in use of the pressing force adjusting device 50 is enhanced.

As illustrated in FIGS. 4, 5 and 7, the driving gear 53 may be coupled to a worm wheel 56 through a connecting shaft 57. The worm wheel 56 may include a worm gear with a worm 55 provided at an end of the driving source 54. If the driving source 54 operates, the worm 55 and the worm wheel 56 rotate, and the driving gear 53 also rotates with the worm wheel 56. The power transmission structure between the driving source 54 and the driving gear 53 may be configured having other gear connecting mechanisms, or other transmission structures.

As illustrated in FIG. 3, the driving gear 53 may be provided in pairs at the first and second side portions 46 and 47 of the opening/closing cover 22, and the driving source 54 and the worm gear may be provided only at the first side portion 46 (referring to FIG. 6) of the opening/closing cover 22. Because a pair of driving gears 53 and 53' are coupled through the connecting shaft 57, both of the driving gears 53 and 53' can be driven by the single driving source 54 and worm gear. As illustrated in FIG. 6, the connecting shaft 57 may be rotatably supported by a support hole 22*c* provided at the opening/closing cover 22.

As illustrated in FIG. 1, the opening/closing cover 22 may be hingedly coupled to the main body 10 by a second hinge shaft 24. When it is needed to expose the fusing unit 30 to remove a jammed printing medium or to repair or replace components, the opening/closing cover 22 can be opened by rotating on the second hinge shaft 24. As illustrated in FIG. 2, the opening/closing cover 22 may be provided with press release protrusions 25 and press protrusions 26 at the first and second side portions 46 and 47. When the opening/closing cover 22 is opened, each of the press release protrusions 25 pushes against the adjusting lever 41 to separate the press roller 35 from the heating roller 34. When the opening/closing cover 22 is closed, each of the press protrusions 26 rotates the adjusting lever 41, which has been rotated by a predetermined angular distance in the forward direction, in the reverse direction to return the press roller 35 to the initial position to closely contact the heating roller 34.

Hereinafter, the operation of the image forming apparatus 5 according to the present general inventive concept will be described with reference to FIGS. 9A-10C.

Figure 9A:
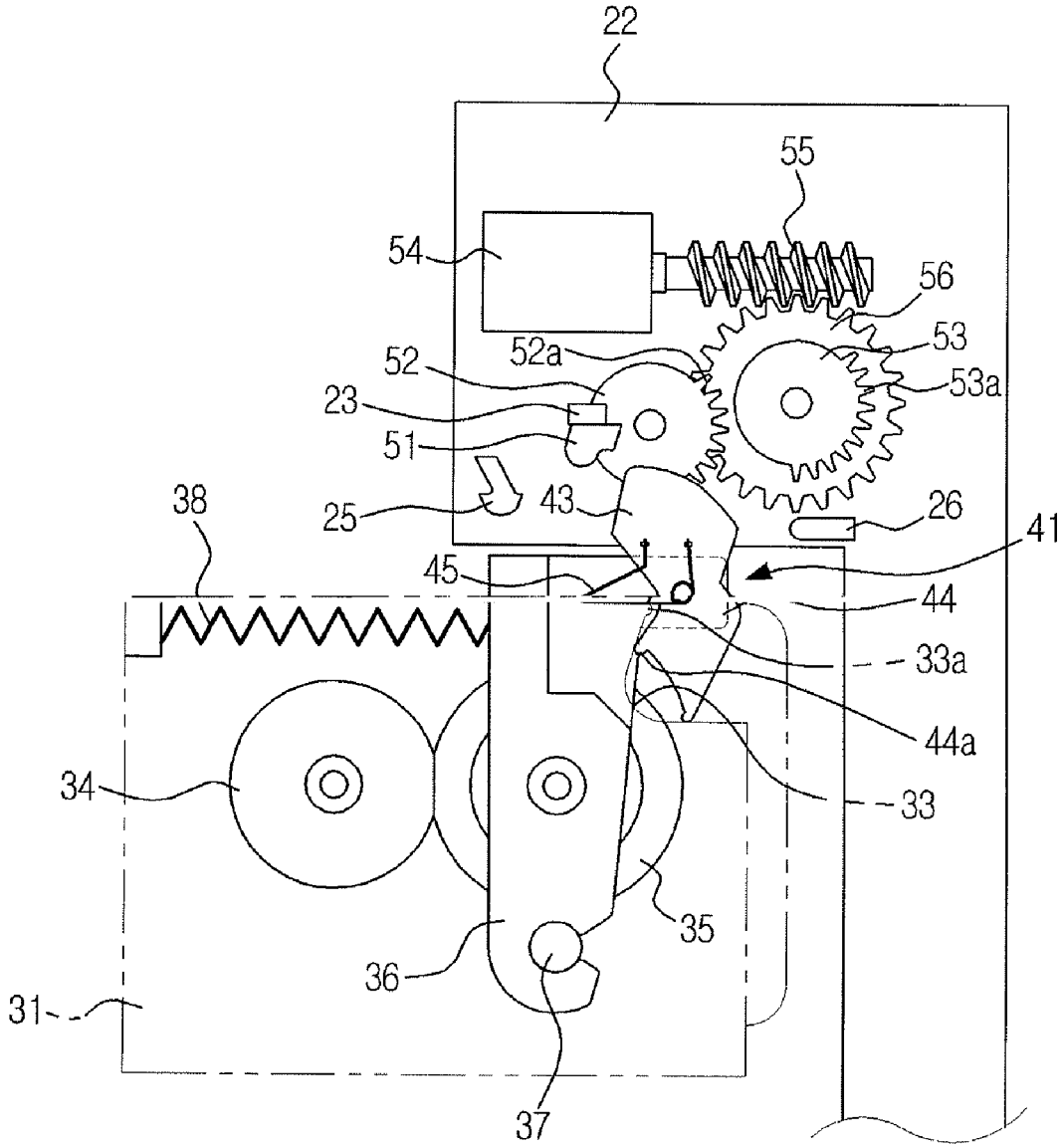
FIGS. 9A to 9C are side views to illustrate an operation of the pressing force adjusting device of the image forming apparatus in accordance with the present general inventive concept.

As illustrated in FIG. 9A, when a common printing medium (e.g., A4 paper) is to be printed, the press roller 35 closely contacts the heating roller 34 by the elastic force provided by the first elastic member 38. During the printing operation, the heating roller 34 and the press roller 35 rotate while closely contacting each other, and apply heat and pressure to the printing medium which passes therebetween.

Figure 9B:
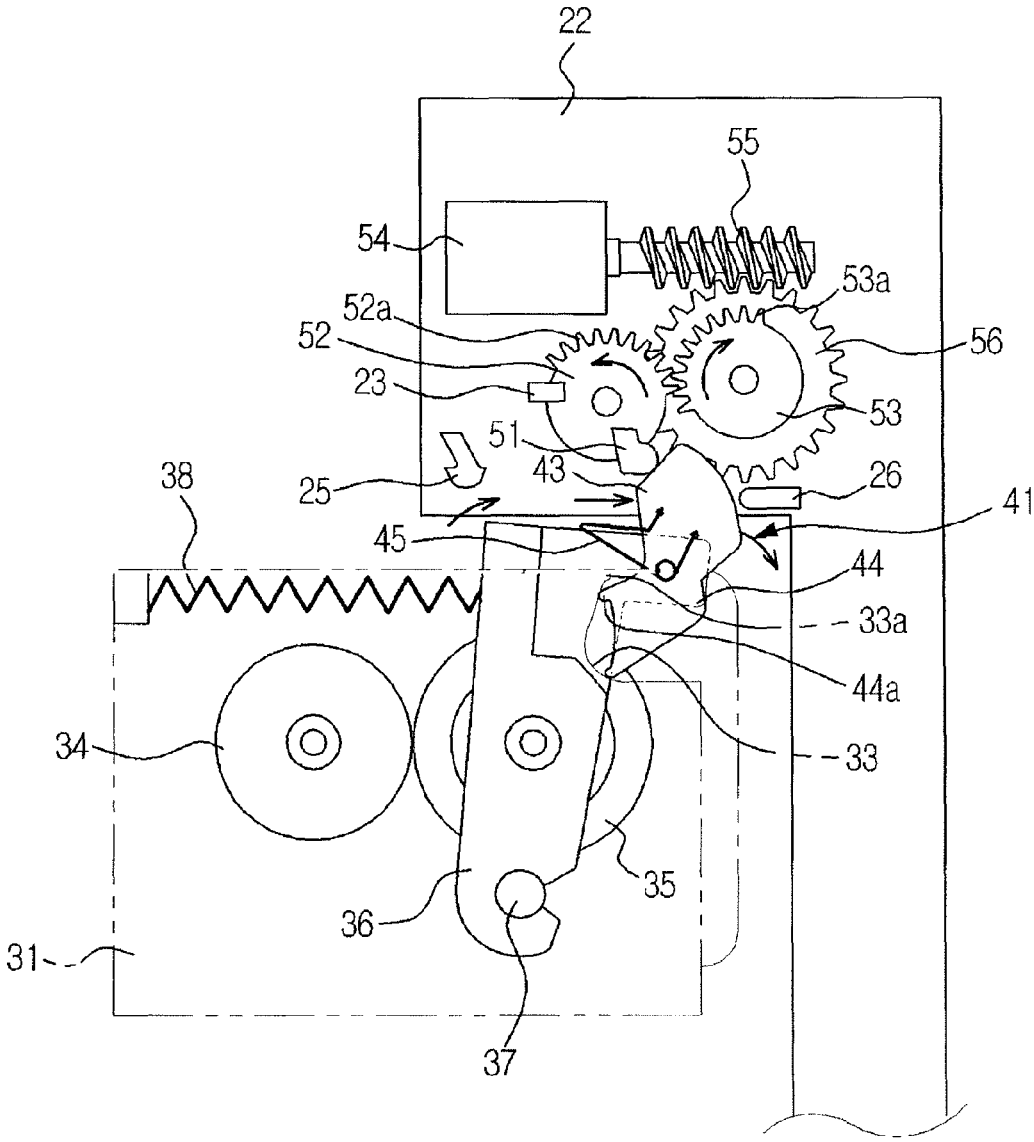

When a printing medium (e.g., an envelope) thicker than the common printing medium is to be printed, if the corresponding printing medium is selected, as illustrated in FIG. 9*b*, the driving source 54 operates to rotate the worm 55, and the worm wheel 56 which is tooth-engaged with the worm 55 and the driving gear 53 which is coupled to the worm wheel 56 rotate in the forward direction. If the driving gear 53 rotates such that the gear teeth 53*a* are engaged with the gear teeth 52*a* of the operating gear 52, the operating gear 52 rotates in the reverse direction. If the operating gear 52 rotates such that the detected part 52*d* (referring to FIG. 5) is positioned in the sensing region 61 of the position sensor 60 (referring to FIG. 5), the control device 21 (refer to FIG. 1) stops the rotation of the driving source 54. Accordingly, the operating gear 52 is stopped after rotating by a predetermined angular distance.

If the operating gear 52 rotates in the reverse direction, the operating member 51 comes into contact with and presses against the first lever portion 43 of the adjusting lever 41, and the adjusting lever 41 then rotates in the forward direction on the hinge portion 42 while the second lever portion 44 comes into contact with the contact portion 33 of the frame 31. When this occurs, the press lever 36 is pulled forward by the adjusting lever 41 and rotates by a predetermined angular distance in the forward direction, and the press roller 35 moves away from the center axis of the heating roller 34, so that the pressing force between the heating roller 34 and the press roller 35 is decreased to a fusing pressure adequate for the relatively thicker printing medium.

Regulation of the fusing pressure by the operating member 51 can be achieved in a multi-step range according to the thickness of the printing medium to be printed by adequately adjusting the rotational angular distance of the operating gear 52.

The selection of the printing medium may be achieved through the external input device 70, such as a display or a computer. If a user selects the printing medium when inputting a printing command, the pressing force adjusting device 50 operates to automatically adjust the fusing pressure adequately for the selected printing medium. In the present general inventive concept, the selection of the printing medium may be achieved through an input means such as a manipulation button (not illustrated) provided at the image forming apparatus, or may be automatically achieved through a printing medium sensing means (not illustrated) capable of detecting the thickness of the printing medium to be printed.

Figure 9C:
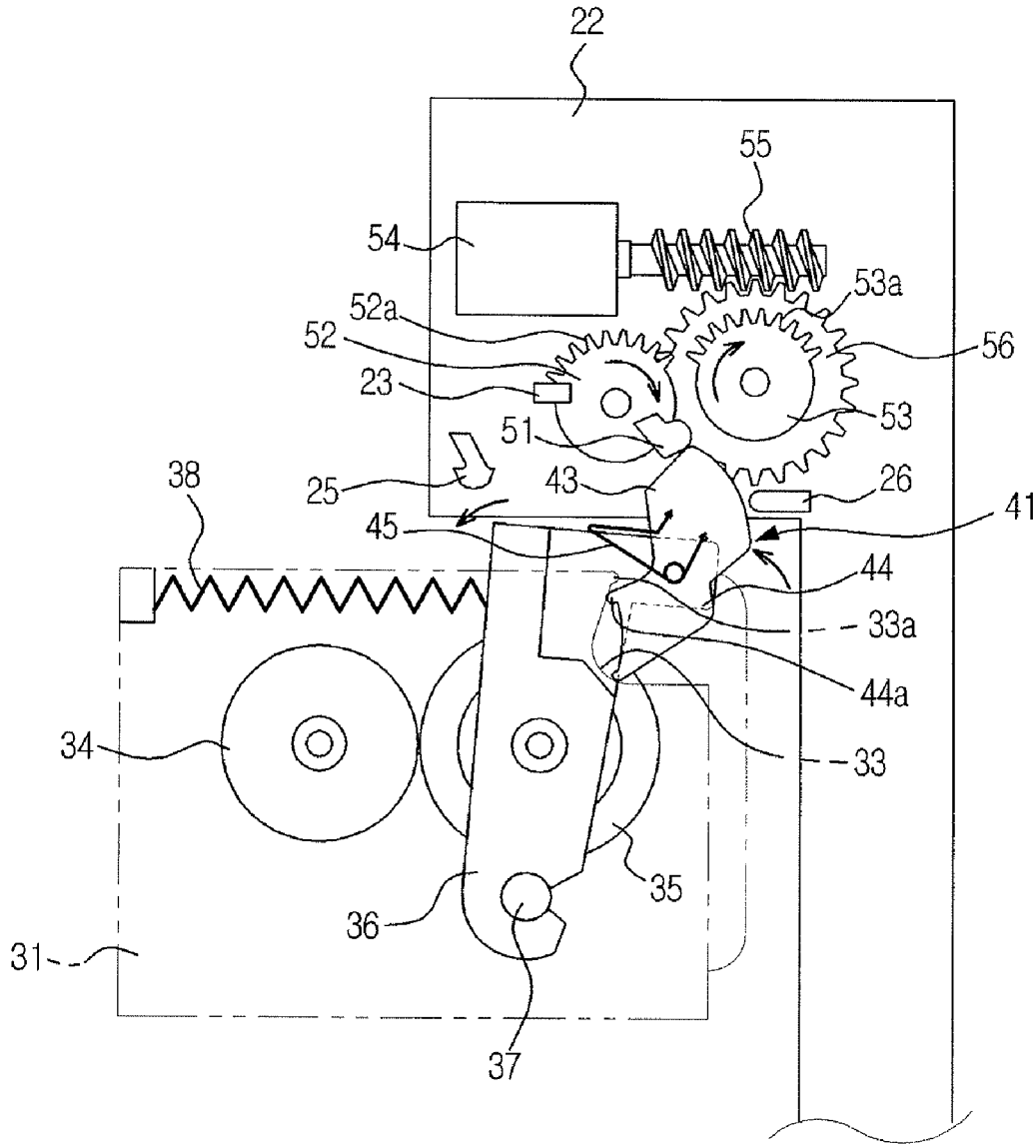

In another embodiment, if the common printing medium is to be used again when the fusing pressure between the heating roller 34 and the press roller 35 is in a decreased state (that is, the fusing pressure is set for printing medium thicker than the common printing medium), as illustrated in FIG. 9C, the control device 21 drives the driving source 54 to rotate the driving gear 53 more in the forward direction. If the driving gear 53 rotates such that the gear teeth 53*a* are disengaged from the gear teeth 52*a* of the operating gear 52, the operating gear 52 is returned to the initial position by the elastic force provided by the second elastic member 58 (referring to FIG. 6). When this occurs, the driving source 54 is stopped after operating for a predetermined time or by a predetermined number of rotations.

In another embodiment of the present general inventive concept, the return of the operating gear 52 may be achieved by the driving source 54 (that is, not by the second elastic member 58). In this embodiment, the driving source 54 is configured as a motor capable of rotating in the forward/reverse directions. If the driving source 54 changes the rotational direction, the operating gear 52 can be returned by the driving source 54 to the initial position.

Figure 10A:
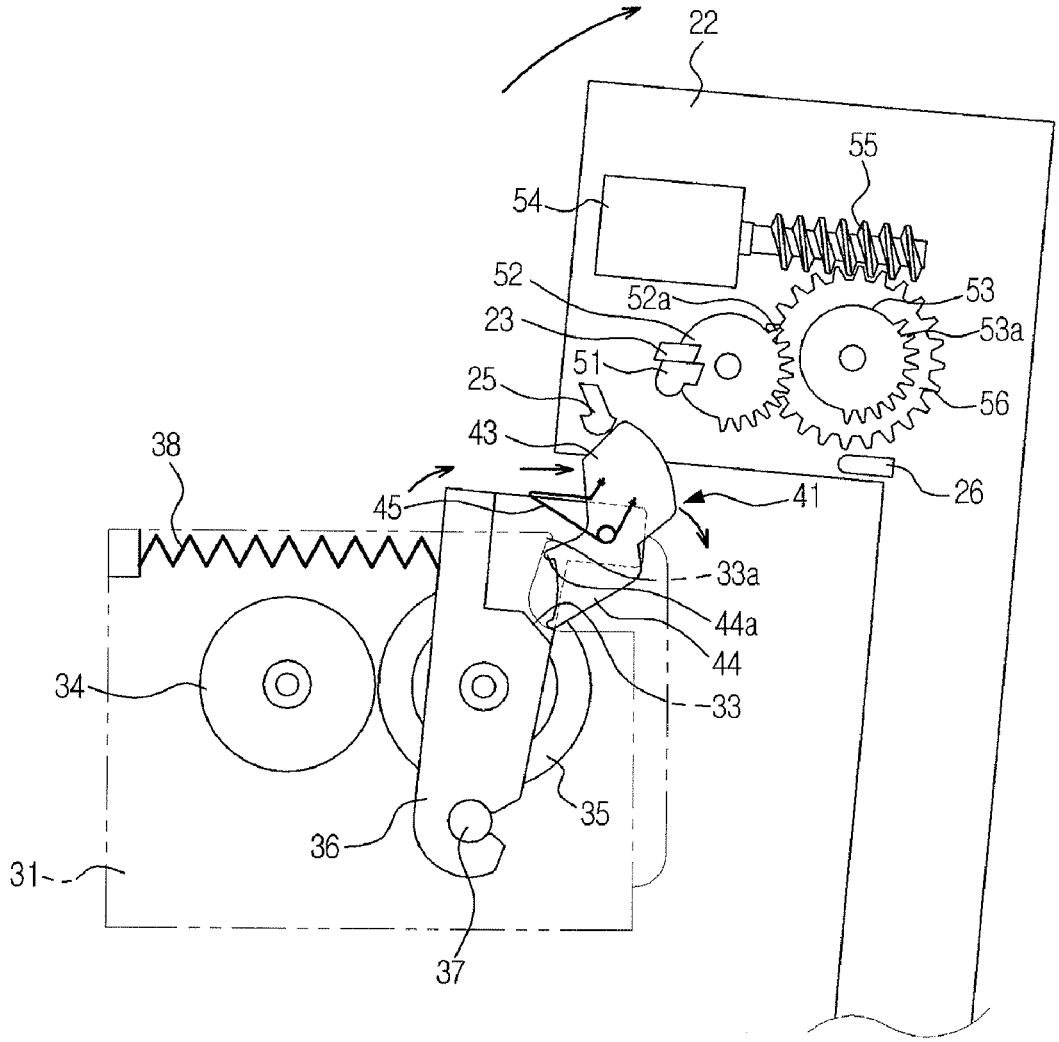
FIGS. 10A to 10C are side views to illustrate an operation of an opening/closing cover of the image forming apparatus in accordance with the present general inventive concept.
Figure 10B:
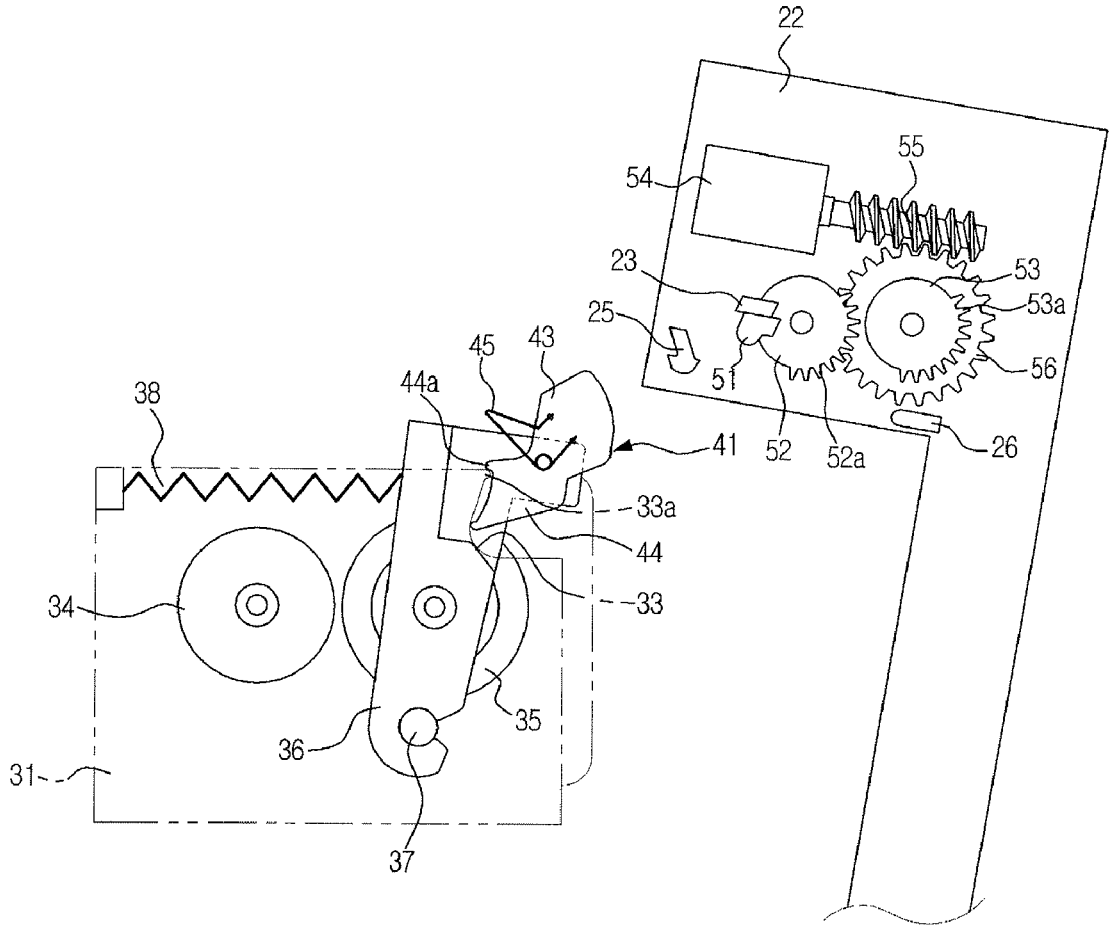

As illustrated in FIG. 10A, if the opening/closing cover 22 is opened, the press release protrusion 25 presses the adjusting lever 41 to rotate in the forward direction. When this occurs, the press lever 36 also rotates in the forward direction, and the press roller 35 is separated from the heating roller 34. As illustrated in FIG. 10B, if the adjusting lever 41 rotates continuously such that the fixing protrusion 44*a* of the second lever portion 44 is positioned over the latching protrusion 33*a* of the frame 31, the fixing protrusion 44*a* is caught by the latching protrusion 33*a*, and the adjusting lever 41 is kept in a stationary state while pulling the press lever 36 forward. Accordingly, the press roller 35 is kept a predetermined distance in a separated state from the heating roller 34.

Figure 10C:
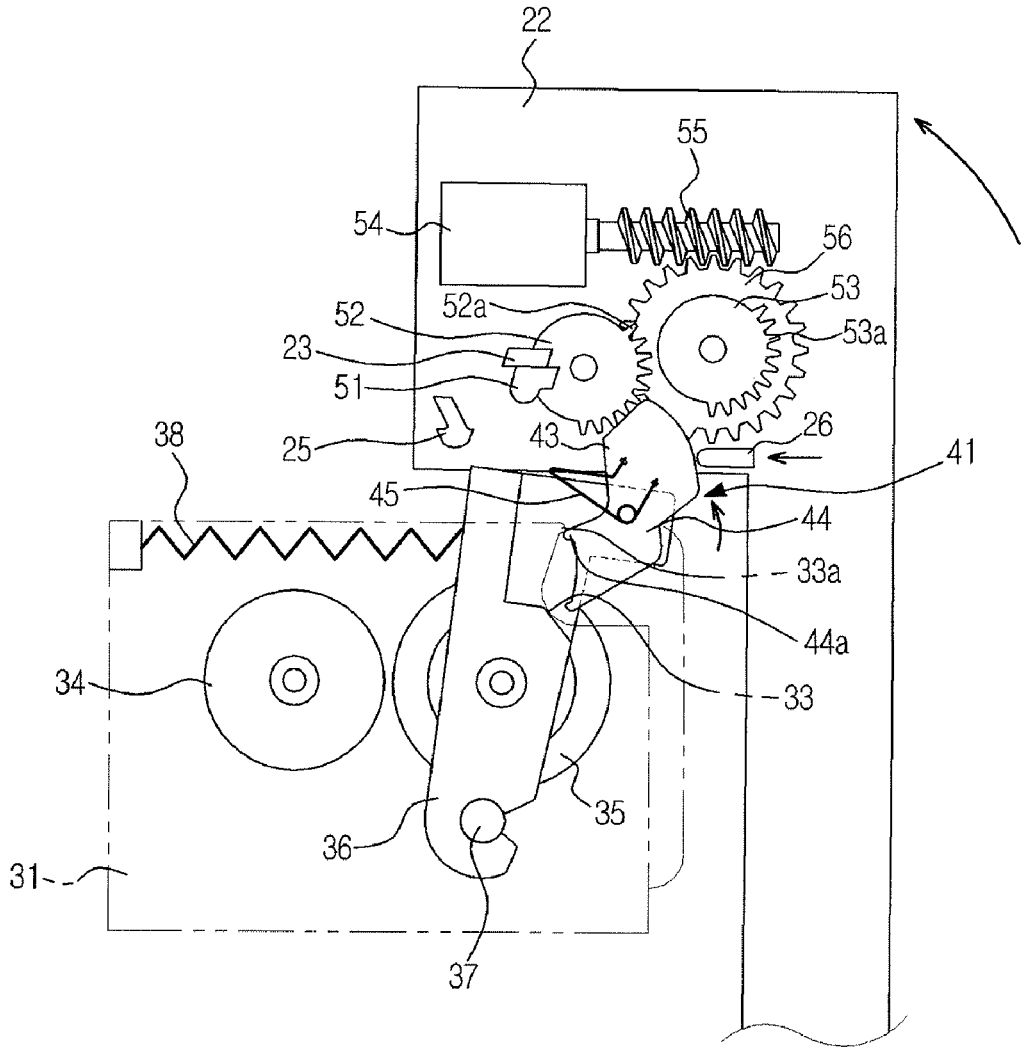

As illustrated in FIG. 10C, if the opening/closing cover 22 is again closed, the press protrusion 26 of the opening/closing cover 22 presses the first lever portion 43 of the adjusting lever 41. The fixing protrusion 44*a* of the adjusting lever 41 is freed from the latching protrusion 33*a* of the frame 31, and the press lever 36 and the press roller 35 are returned to the initial position by the elastic force provided by the first elastic member 38.

If the opening/closing cover 22 is opened or closed when the operating gear 52 is in a rotating state of a predetermined angular distance, the control device 21 drives the driving source 54 to return the operating gear 52 and the operating member 51 to the initial position. Accordingly, if the opening/closing cover 22 is opened or closed, the pressing force between the heating roller 34 and the press roller 35 is initialized into a fusing pressure adequate for the common printing medium (e.g., A4 paper).

In another embodiment of the present general inventive concept, the fusing pressure between the heating roller 34 and the press roller 35 can be adjusted according to the kind of printing medium as well as the thickness of the printing medium. In this embodiment, the control device 21 controls the driving source 54, according to the thickness or the kind of printing medium, to adjust the fusing pressure.

Also, in the present general inventive concept, if the operating member 51, the operating gear 52 and the driving gear 53 are adequately modified, the maximum rotational angular distance of the adjusting lever 41 caused by the contact of the operating member 51 can be increased. In this embodiment, the pressing force between the heating roller 34 and the press roller 35 can be adjusted through modification of the operating member 51, and the heating roller 34 and the press roller 35 can be completely separated from each other. Accordingly, when a jam occurs, the heating roller 34 and the press roller 35 can be completely separated from each other through the movement of the operating member 51 without a need to manipulate the opening/closing cover 22, and the jammed printing medium can be removed.

In the above description, a laser printer has been exemplified as the image forming apparatus according to the present general inventive concept. However, the present general inventive concept can also be applied to any other electrophotographic image forming apparatus having a fusing unit, such as a copying machine, a multi-function printer, a fax machine, or the like.

As apparent from the above description, the image forming apparatus according to the present general inventive concept can adjust the pressing force between the heating roller and the press roller using a relatively small force, when compared to a conventional apparatus, because the press roller can be easily moved by pressing the adjusting lever which is hingedly coupled to the press lever which supports the press roller.

Further, since the press roller may be completely separated from the heating roller by manipulating the adjusting lever which is hingedly coupled to the press lever, a jammed printing medium can be easily removed.

Although a few exemplary embodiments of the present general inventive concept have been illustrated and described, it would be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a photosensitive body on which an electrostatic latent image is to be formed;

an exposure device to radiate light to the photosensitive body to form the electrostatic latent image;

a developing device to adhere a developer to the photosensitive body to form a visible image;

a transfer device to transfer the visible image formed on the photosensitive body onto a printing medium;

a fusing unit comprising a heating roller to apply heat to the printing medium, a press roller to contact the heating roller to press the printing medium, a press lever to press any one of the heating roller and the press roller toward the other, an adjusting lever rotatably coupled to the press lever, an operating member to operate the adjusting lever to adjust the pressing force of the press lever, and a driving source to operate the operating member;

an operating gear coupled to the operating member, the operating gear having gear teeth disposed only on a portion of its outer periphery; and a driving gear disposed between the driving source and the operating gear to transmit a driving force from the driving source to the operating gear, the driving gear having gear teeth disposed only on a portion of its outer periphery.

2. The image forming apparatus according to claim 1, further comprising:

a first elastic member to elastically support the press lever.

3. The image forming apparatus according to claim 1, further comprising:

a frame to rotatably support the press lever, wherein the adjusting lever includes a hinge portion coupled to the press lever, a first lever portion that extends from one side of the hinge portion to be pressed by the operating member, and a second lever portion that extends from an opposite side of the hinge portion, and when the operating member presses the first lever portion, the second lever portion rotates on the hinge portion while contacting the frame, and rotates the press lever.

4. The image forming apparatus according to claim 1, further comprising:

a position sensor to detect a rotational position of the operating gear; and a control device to receive a detecting signal from the position sensor and to control an operation of the driving source.

5. The image forming apparatus according to claim 4, wherein the operating gear is provided with a detected part which extends outwardly therefrom, and the position sensor is provided with a sensing region to sense the detected part, whereby when the operating gear rotates such that the detected part is located in proximity to the sensing region, the position sensor generates the detecting signal.

6. The image forming apparatus according to claim 5, wherein the sensing region is provided in plural numbers in the position sensor to detect a position of the detected part and to provide a multi-step detect range, whereby the rotation of the operating gear is controlled according to the position of the detected part, and a fusing pressure between the heating roller and the press roller is set according to the multi-step detect range.

7. The image forming apparatus according to claim 1, further comprising:

a worm wheel which is coupled to the driving gear; and a worm which is provided at the driving source and is tooth-engaged with the worm wheel.

8. The image forming apparatus according to claim 1, further comprising:

a second elastic member to elastically support the operating gear and to return the operating gear to an initial position when the gear teeth of the operating gear are disengaged from the gear teeth of the driving gear; and a stopper to stop the operating gear returned by the second elastic member at the initial position.

9. The image forming apparatus according to claim 1, further comprising:

a cover movably mounted to a main body of the image forming apparatus, to move between an opened position and a closed position, wherein the driving source, the operating gear and the driving gear are coupled to the cover.

10. The image forming apparatus according to claim 9, wherein the press lever, the adjusting lever and the operating member are respectively provided in pairs at a first and second side portions of the frame, the operating gear and the driving gear are respectively provided in pairs at the first and second side portions of the opening/closing cover, and the pair of the driving gears are connected to each other through a connecting shaft to rotate together by the driving source.

11. The image forming apparatus according to claim 9, wherein when the cover is opened, the operating gear returns to an initial position.

12. A fusing unit, comprising:

a frame;

a heating roller mounted to the frame to apply heat to a printing medium;

a press roller mounted to the frame to contact the heating roller to press the printing medium;

a press lever to press any one of the heating roller and the press roller to the other;

an adjusting lever hingedly coupled to the press lever, the adjusting lever having a portion to rotate while contacting the frame;

an operating member to operate the adjusting lever to move the press lever;

a driving source to operate the operating member;

an operating gear coupled to the operating member, the operating gear having gear teeth disposed only on a portion of its outer periphery; and a driving gear disposed between the driving source and the operating gear to transmit a driving force from the driving source to the operating gear, the driving gear having gear teeth disposed only on a portion of its outer periphery.

13. The fusing unit according to claim 12, further comprising:

a first elastic member to elastically support the press lever.

14. The fusing unit according to claim 12, wherein the press lever is hingedly coupled to the frame, the adjusting lever includes a hinge portion that is hingedly coupled to the press lever, a first lever portion that extends from one side of the hinge portion to be pressed by the operating member, and a second lever portion that extends from an opposite side of the hinge portion, and when the operating member presses the first lever portion, the second lever portion rotates on the hinge portion while contacting the frame and moves the press lever.

15. The fusing unit according to claim 12, further comprising a position sensor to detect a rotational position of the operating gear.

16. The fusing unit according to claim 15, wherein the operating gear is provided with a detected part which extends outwardly therefrom, and the position sensor is provided with a sensing region to sense the detected part, whereby when the operating gear rotates such that the detected part is located in the proximity of the sensing region, the position sensor generates a detecting signal.

17. The fusing unit according to claim 16, wherein the sensing region is provided in plural numbers in the position sensor to detect a position of the detected part, whereby the rotation of the operating gear is controlled according to the position of the detected part, and a fusing pressure between the heating roller and the press roller is changed in a multi-step process.

18. The fusing unit according to claim 12, further comprising:

a second elastic member to elastically support the operating gear and to return the operating gear to an initial position when the gear teeth of the operating gear are disengaged from the gear teeth of the driving gear; and a stopper to stop the operating gear returned by the second elastic member at the initial position.

* * * * *